US006810867B2

(12) United States Patent
Schmid et al.

(10) Patent No.: US 6,810,867 B2
(45) Date of Patent: Nov. 2, 2004

(54) EXHAUST GAS RECIRCULATION DEVICE

(75) Inventors: Hans-Peter Schmid, Baltmannsweiler (DE); Matthias Seltsam, Asperg (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/419,156

(22) Filed: Apr. 21, 2003

(65) Prior Publication Data

US 2003/0178013 A1 Sep. 25, 2003

Related U.S. Application Data

(63) Continuation of application No. 09/785,662, filed on Feb. 20, 2001, now abandoned.

(30) Foreign Application Priority Data

Feb. 17, 2000 (DE) ..... 100 07 243

(51) Int. Cl.[7] ..... F02M 25/07
(52) U.S. Cl. ..... 123/568.17

(58) Field of Search ..... 123/568.11, 568.12, 123/568.15, 568.17, 568.18, 590, 306

(56) References Cited

U.S. PATENT DOCUMENTS

| | | | | | |
|---|---|---|---|---|---|
| 1,539,126 | A | * | 5/1925 | Vincent | 123/568.17 |
| 3,662,722 | A | * | 5/1972 | Sarto | 123/568.17 |
| 4,092,959 | A | * | 6/1978 | Mayer et al. | 123/568.17 |
| 4,327,698 | A | * | 5/1982 | Hamai et al. | 123/568.17 |
| 5,322,043 | A | * | 6/1994 | Shriner et al. | 123/568.17 |
| 5,535,717 | A | * | 7/1996 | Rygiel | 123/306 |
| 6,425,382 | B1 | * | 7/2002 | Marthaler et al. | 123/568.17 |

* cited by examiner

*Primary Examiner*—Willis R. Wolfe, Jr.
(74) *Attorney, Agent, or Firm*—Crowell & Moring LLP

(57) ABSTRACT

A mixing device is provided for an exhaust gas recirculation system of an internal combustion engine with an intake air line and an exhaust gas recirculation line. The outlet opening of the recirculation line or admission opening of the intake air line opens into the intake air line and a swirl generating element and/or a turbulence generating element is provided in the area of the admission opening of the mixing device.

20 Claims, 4 Drawing Sheets

EXHAUST GAS RECIRCULATION DEVICE

BACKGROUND AND SUMMARY OF THE INVENTION

This application is a continuation of application Ser. No. 09/785,662, filed Feb. 20, 2001. This application claims the priority of German Patent Document 100 07243.7, filed in Germany, Feb. 17, 2000, the disclosure of which is expressly incorporated by reference herein.

The invention relates to a mixing device for an exhaust gas recirculation system of an internal combustion engine with an intake air line and an exhaust gas recirculation line, the outlet opening or admission opening of which opens into the intake air line.

A device of the aforementioned type is already known, which provides for centric feeding of the exhaust gas into the charge air line. In this the exhaust gases enter centrically in relation to the intake air flow and in the same direction of flow. At best, however, mixing between exhaust gas flow and intake air flow occurs only in the marginal areas, depending on the relative speed of exhaust gas and intake air. Mixing of the exhaust gases fed in over the short distance between admission point and charge air distributor is therefor very poor, so that the major part of the exhaust gas flow is propagated as far as the last cylinder in the charge air distributor.

German Patent Document DE 43 19 380 C2 discloses an exhaust gas recirculation device for an internal combustion engine with an exhaust turbocharger, with an inlet system, a charge air line, an exhaust system, a return line for an exhaust gas component flow, together with a jet diffuser unit to which charge air is admitted and into which the return line also opens, the jet diffuser unit being arranged directly in the charge air line and the jet diffuser unit, when suitably designed, producing an equilibrium of the pressure differentials between exhaust and inlet system, so that an exhaust gas component flow can be added to the compressed charge air though the return line opening into the jet diffuser unit in the area of a cross-sectional constriction and thereby fed to the inlet system. Optimum mixing of intake air and exhaust gas is not guaranteed, however, because the exhaust gas flows in the marginal area and there is no further additionally generated swirl or turbulence to promote further mixing of the two gas flows.

Accordingly, an object of the invention is to design and arrange the mixing point and/or feed device in such a way that optimum mixing of the exhaust gas with the intake air can be guaranteed.

According to the invention this object is achieved in that a swirl generating element and/or a turbulence generating element is/are provided in the area of the admission opening of the mixing device. As a result the exhaust gas fed to the intake air is optimally mixed in, so that in the downstream mixing zone or mixing line a virtually homogeneous intake air-exhaust gas mixture is produced, in particular because swirling of both gas flows occurs over the entire cross-section of the charge air line.

It is advantageous for this purpose for the swirl generating element and/or the turbulence generating element to be designed as part of a mixing device and as a swirl duct, the swirl duct having internal deflector elements or deflector plates for the exhaust gas in the area of the admission opening and the deflector elements being of helical and/or volute design. The exhaust gas flowing in is set in rotation or is subjected to a swirling movement by the internal deflector plates in the area of the admission opening of the exhaust gas recirculation line, so that optimum mixing of the exhaust gas into the intake air flow is achieved.

According to a development of certain preferred embodiments of the invention an additional possibility is to design the swirl generating element and/or the turbulence generating element of the mixing device as a swirl grille, the swirl grille having deflector elements or deflector plates distributed over the circumference and being arranged in the exhaust gas recirculation line in the area of the admission opening. The deflector plates firstly therefore impart a radial component or a rotational component to the emerging exhaust gas or its direction of flow, so that this superimposition of the two additional flow movements on the existing axial component ensures very efficient mixing of the exhaust gas into the intake air flow.

It is furthermore advantageous according to certain preferred embodiments of the invention for the exhaust gas recirculation line or the admission opening to extend tangentially to the intake air line. Consequently the exhaust gas flow likewise enters the intake air line tangentially. At the admission point this flow movement of the inlet exhaust gas is now superimposed on the intake air flow running essentially axially. As a result this leads to a mixing flow, which has kinetic components both in an axial direction and in a circumferential direction, so that an extremely short mixing distance is achieved.

It is also advantageous according to certain preferred embodiments of the invention for the mixing device to have a baffle element for the exhaust gas in the area of the admission opening, the baffle element being designed as a cone or plate and having deflector elements or deflector plates arranged helically and/or volutely on its surface. The conical baffle element imparts a radial component to the exhaust gas emerging axially from the exhaust gas recirculation line, which radial component, owing to the helical deflector plate, is superimposed on a kinetic component in a circumferential direction. Added to this is a swirling effect on separation of the flow at the end or at the edge of the baffle element. The result is again very efficient mixing of the exhaust gas into the intake air flow.

According to certain preferred embodiments of the solution according to the invention it is further proposed that the exhaust gas recirculation line be of helical, volute, spiral, eccentric and/or concentric design in the area of the admission opening. A rotational impulse or swirl is therefore imparted to the entire exhaust gas flow, optimizing the mixing with the intake air flow.

It is of particular importance according to certain preferred embodiments of the invention that the swirl generating element and/or the turbulence generating element be arranged eccentrically and/or concentrically in the exhaust gas recirculation line and/or in the intake air line in the area of the admission opening. The generation of swirling and/or turbulent motions can be induced in the exhaust gas flow and/or in the intake air flow, since the respective mixing effect is transmitted by the interchange of impulses of the two flows.

In the context of the design and arrangement according to the invention it is advantageous according to certain preferred embodiments of the invention for the admission opening to be designed as a jet or diffuser and arranged coaxially in the intake air line, the ratio of the diameter of the intake air line to that of the exhaust gas recirculation line have a value between three and ten. Mixing can be promoted and the pressure ratio optimized by way of the cross-sectional shape of the admission opening according to the pressure ratios prevailing in the exhaust line and the intake air line.

Other objects, advantages and novel features of the present invention will become apparent from the following detailed description of the invention when considered in conjunction with the accompanying drawings.

DETAILED DESCRIPTION OF THE DRAWINGS

Figure 1:
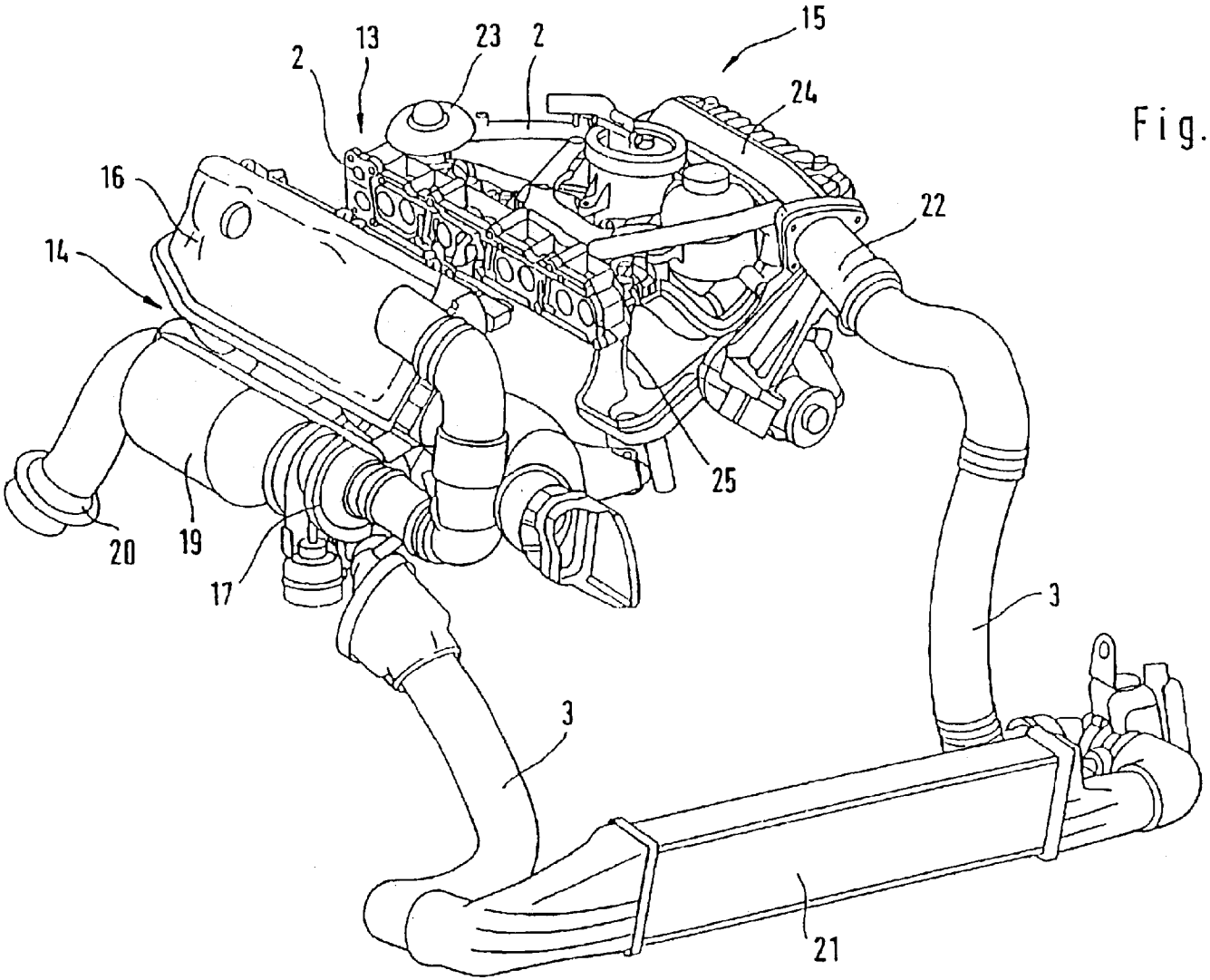
FIG. 1 shows a perspective view of an inlet and exhaust system of an internal combustion engine constructed according to preferred embodiments of the invention.

In the drawings, in FIG. 1, an inlet line system of an internal combustion engine (not shown), which is equipped with an exhaust gas recirculation system 15, is denoted by 13 and an exhaust line system by 14. On the exhaust side an air filter 16 is provided, to which an intake air charger or compressor 17 and an intake air line 3 are connected. Likewise on the exhaust side there is a catalytic converter, to which an exhaust system 20 is connected.

A charge air cooler 21 is incorporated into the intake air line 3, and downstream of the intake air line is an exhaust gas recirculation device 22. The exhaust gas recirculation device 22 is connected by way of an exhaust gas recirculation line 2 to an exhaust gas recirculation valve 23, which is likewise connected by way of the exhaust gas recirculation line 2 to the exhaust side of the internal combustion engine. The exhaust gas recirculation device 22 is furthermore connected by way of a charge air distributor 24 to inlet ports 25.

The intake air is drawn in by way of the air filter 16 and is compressed by means of the intake air compressor 17. The intake air compressor 17 is driven on the exhaust side by the exhaust gases flowing out, which can flow out into the open air by way of the catalytic converter 19 and the exhaust system 20.

The compressed intake air is cooled in the charge air cooler 21 and is returned by way of the intake air line 3 and the exhaust gas recirculation device 22 to the charge air distributor 24. In the exhaust gas recirculation device 22 exhaust gas is mixed with the compressed and cooled intake air. The exhaust gas is here fed to the exhaust gas recirculation line 2 by way of the exhaust gas recirculation valve 23.

By means of a regulating element the exhaust gas recirculation valve 23 controls the exhaust gas flow delivered to the intake air in the exhaust gas recirculation device 22, so that an homogeneous intake air-exhaust gas mixture is produced in the charge air distributor 24. This homogeneous intake air-exhaust gas mixture is delivered to the cylinders (not shown) by way of the inlet ports 25.

Figure 2:
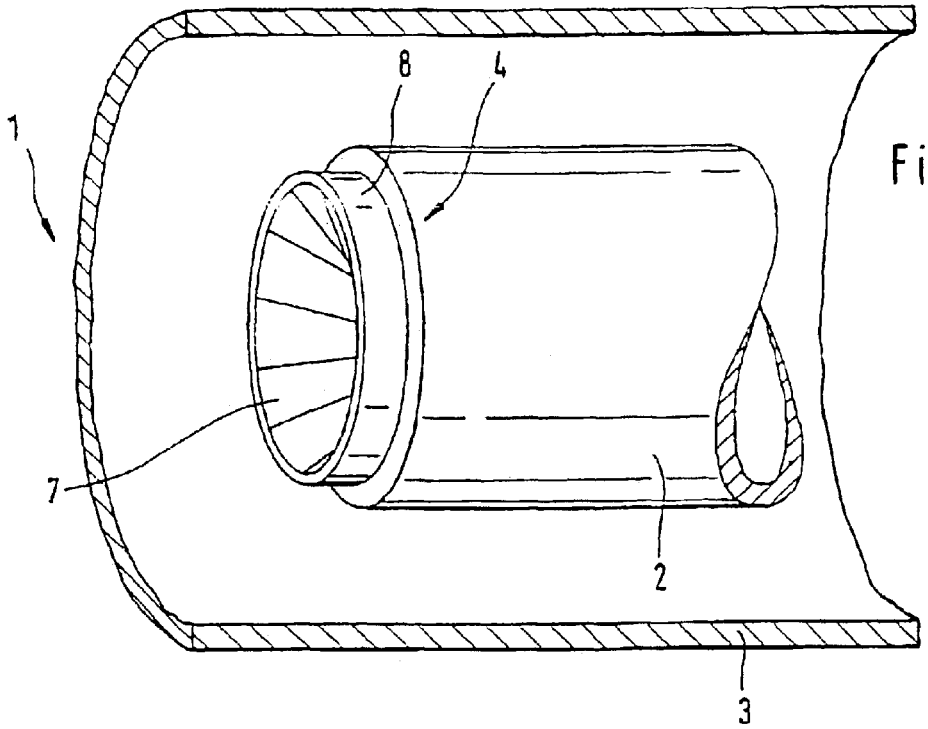
FIG. 2 shows a swirl grille at the opening point of the exhaust gas recirculation line constructed according to a preferred embodiment of the invention.

In FIG. 2 a mixing device denoted by 1 has a swirl grille 8 with deflector plates 7 at the end of the exhaust gas recirculation line 2. The exhaust gas recirculation line 2 is arranged coaxially therewith inside the intake air line 3. The deflector plates 7 impart a swirl to the exhaust gas flowing out of the exhaust gas recirculation line 2, and/or the deflector plates generate local areas of turbulence within the exhaust gas flow and within the ensuing mixing flow.

Figure 3:
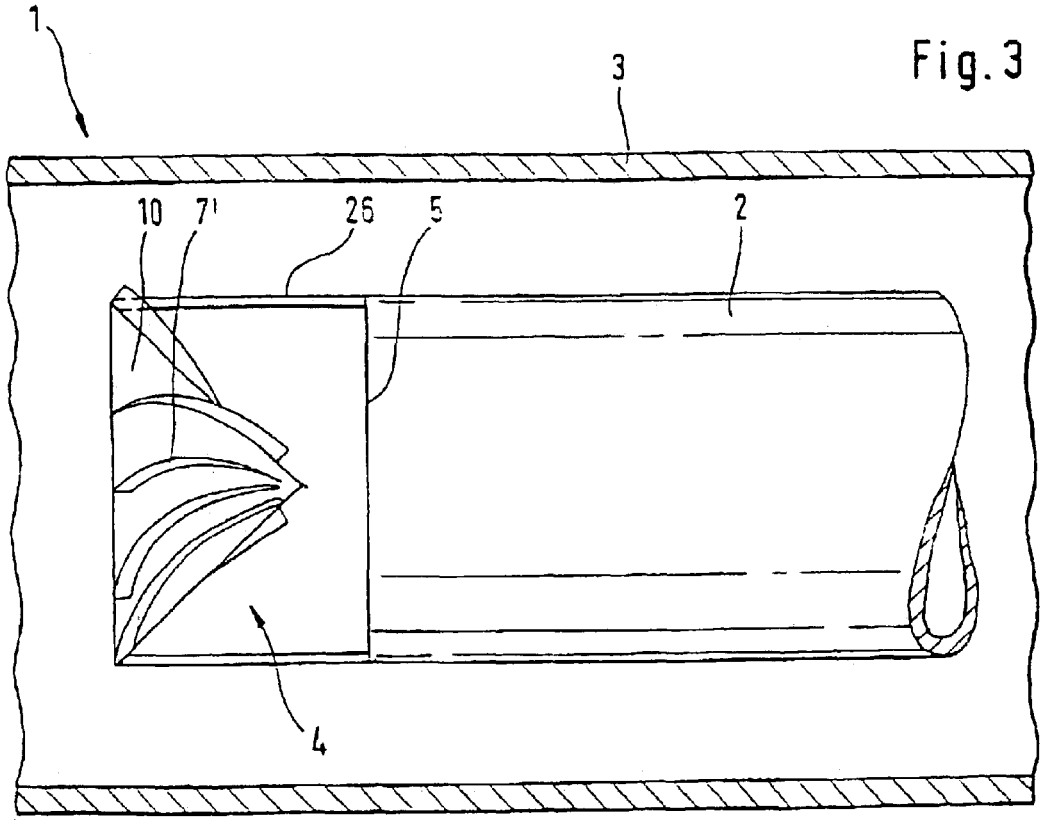
FIG. 3 shows another preferred embodiment of the invention with a baffle element designed as a cone in the area of the opening point of the exhaust gas recirculation line.

In another example of an embodiment according to FIG. 3 a baffle element, which is designed as a cone, is denoted there by 10. The cone has a conical shell, on the surface of which deflector plates are arranged over the circumference. The exhaust gas flowing out of the exhaust gas recirculation line 2 strikes the conical shell or the tip thereof which imparts a radial flow component to the flow. In addition to this radial flow component, deflector plates 7' provided on the shell surface impart a circumferential component to the flow and hence in turn a swirl with local turbulence. The cone or the baffle element 10 is supported by retaining elements 26 in relation to the exhaust gas recirculation line 2 or to the intake air line.

Figure 4:
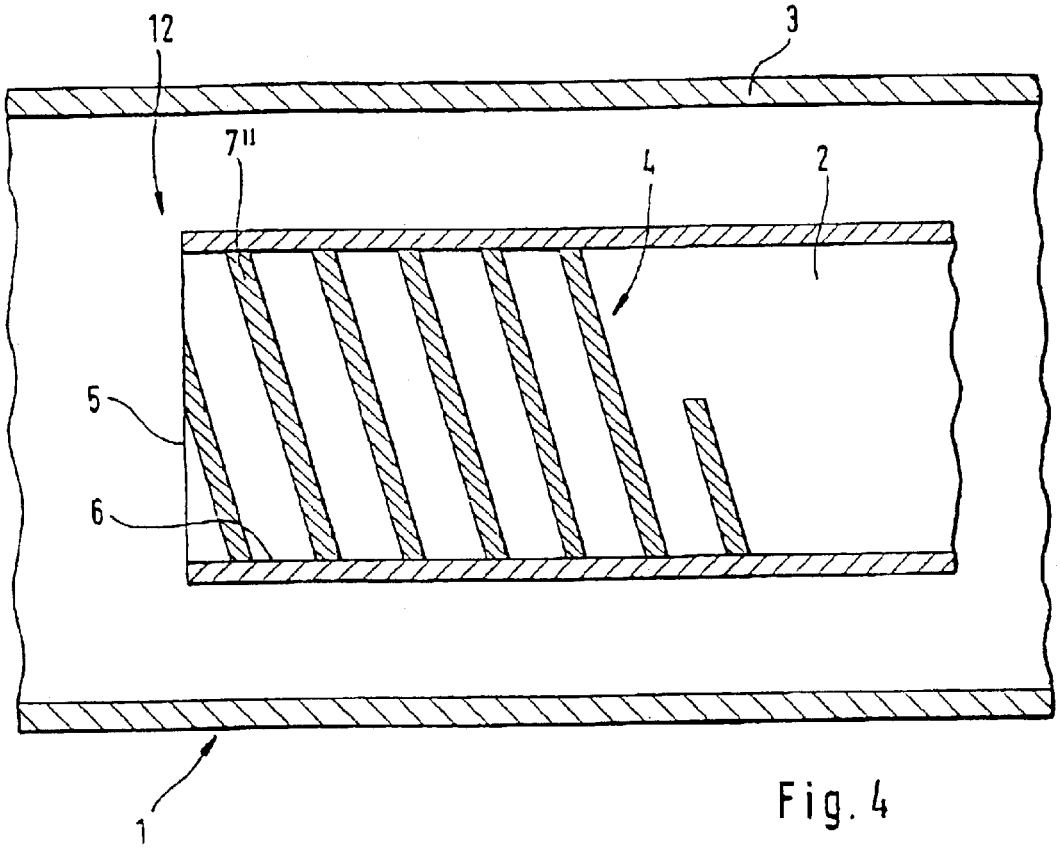
FIG. 4 shows a sectional view of a swirl duct with deflector plate constructed according to a preferred embodiment of the invention.

FIG. 4 represents a third example of an embodiment. 12 denotes a swirl duct, on the inside 6 of an admission opening 5 of which deflector plates 7" are provided. The deflector plates 7" have a helical or volute arrangement, thereby forming a swirl duct 12.

Figure 5:
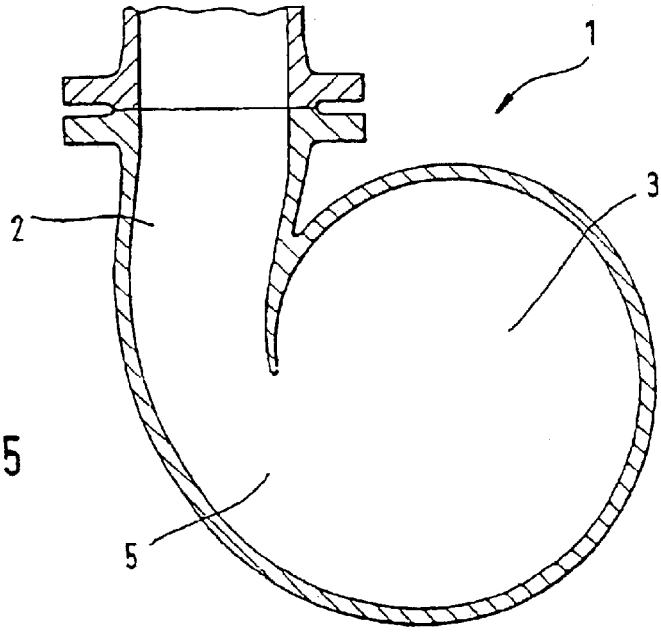
FIG. 5 shows a tangential arrangement of the exhaust gas recirculation line to the intake air line constructed according to a preferred embodiment of the invention.

FIG. 5 shows a tangential arrangement of the exhaust gas recirculation line 2 to the intake air line 3. The exhaust gas is set in rotational or swirling movement by the volute inlet line, so that optimum mixing of the exhaust gas with the intake air is possible.

Figure 6:
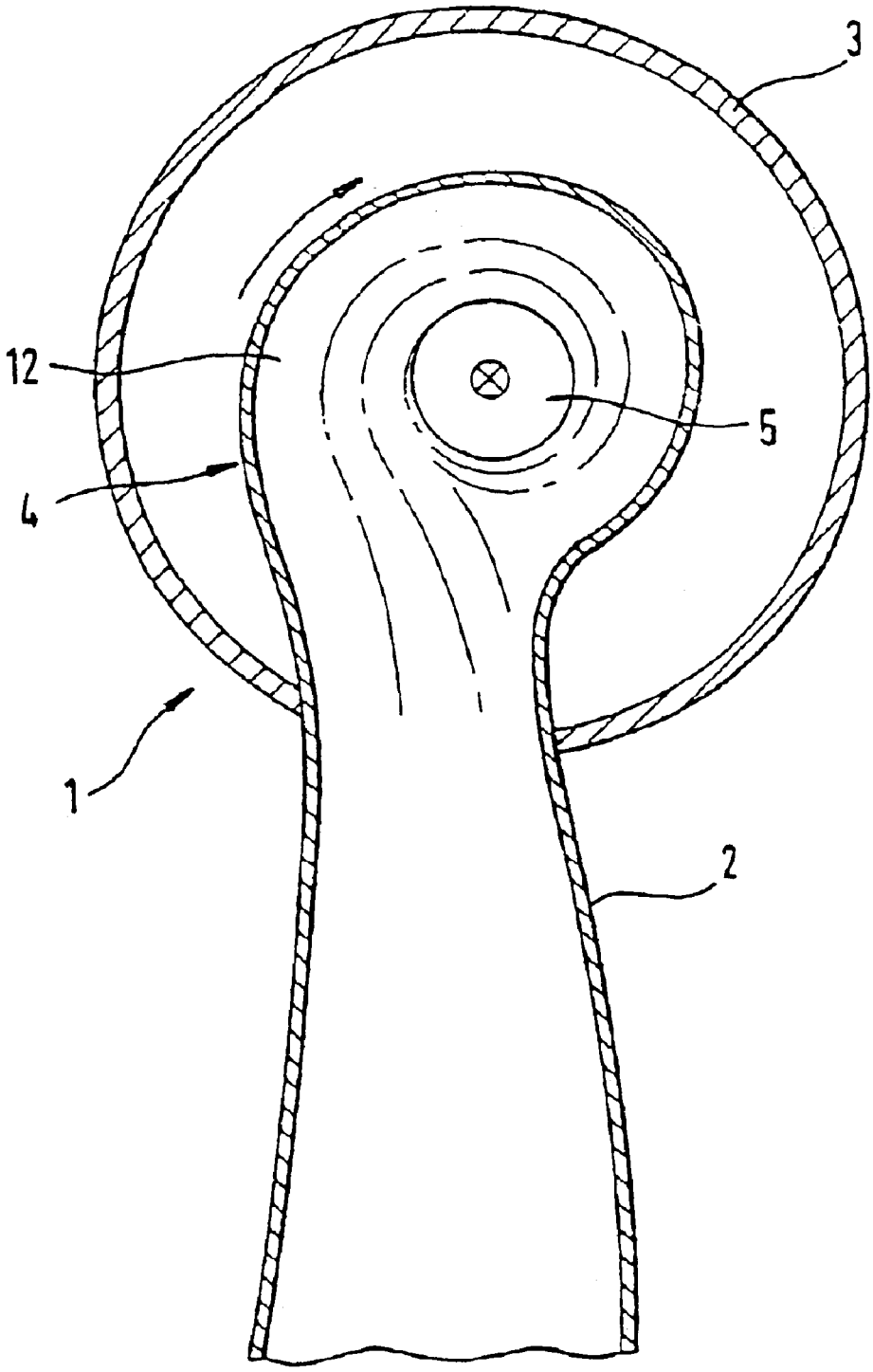
FIG. 6 shows an exhaust gas recirculation line of a helical or volute design with centric exhaust outlet in the intake air line constructed according to a preferred embodiment of the invention.

FIG. 6 shows an exhaust gas recirculation line 2 of helical or volute design in the area of the admission opening 5. It first runs radial into the intake air line 3 from below and has an admission opening 5 arranged centrically in relation to the intake air line 3. The exhaust gas is set in rotation as it flows through the helical or volute part of the exhaust gas recirculation line 2. Due to the shape of the exhaust gas recirculation line 2 the exhaust gas leaving the admission opening 5 possesses a direction of rotation or a swirl that promotes mixing of the exhaust gas into the intake air flow.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mixing device for an exhaust gas recirculation system of an internal combustion engine with an intake air line and an exhaust gas recirculation line, an admission opening of said exhaust gas recirculation line opening into the intake air line, wherein a swirl generating element is provided in an area of the admission opening of the mixing device, wherein the exhaust gas recirculation line extends tangentially to the intake air line at the admission opening.

2. A mixing device for an exhaust gas recirculation system of an internal combustion engine with an intake air line and an exhaust gas recirculation line, an admission opening of said exhaust gas recirculation line opening into the intake air line, wherein a swirl generating element is provided in an area of the admission opening of the mixing device, wherein the mixing device has a baffle element for the exhaust gas in the area of the admission opening, and wherein the baffle element is designed as a cone or plate and has deflector elements or deflector plates helically and/or volutely arranged on its surface.

3. Exhaust gas recirculation assembly comprising:

an engine intake air line:

an exhaust gas recirculation line opening into the intake air line at an admission opening, and a swirl generating device disposed at the admission opening, wherein the exhaust gas recirculation line extends tangentially to the intake air line at the admission opening.

4. Exhaust gas recirculation assembly comprising:

an engine intake air line;

an exhaust gas recirculation line opening into the intake air line at an admission opening, and a swirl generating device disposed at the admission opening, wherein the swirl generating element includes a baffle element for the exhaust gas in an area of the admission opening, and wherein the baffle element includes a cone with deflector elements helically arranged on its surface.

5. A mixing device for an exhaust gas recirculation system of an internal combustion engine with an intake air line and an exhaust gas recirculation line, an admission opening of said exhaust gas recirculation line extending into the intake air line, wherein a swirl generating element is provided in an area of the admission opening of the mixing device and is designed to enhance the mixing of exhaust gas with intake air in the intake air line downstream of the admission opening.

6. The mixing device according to claim 1, wherein the mixing device has a baffle element for the exhaust gas in the area of the admission opening.

7. The mixing device according to claim 1, wherein the exhaust gas recirculation line is of helical, volute, spiral, eccentric and/or concentric design in the area of the admission opening.

8. The mixing device according to claim 1, wherein the swirl generating element is arranged one of concentrically and eccentrically in one of the exhaust gas recirculation line and the intake air line in the area of the admission opening.

9. The mixing device according to claim 1, wherein the admission opening is designed as at least one of a jet and a diffuser and is arranged coaxially in the intake air line.

10. The mixing device according to claim 1, wherein the swirl generating element is part of the mixing device and is designed as a swirl duct.

11. The mixing device according to claim 10, wherein on its inside in the area of the admission opening the swirl duct has deflector elements for the exhaust gas, which deflector elements are of helical and/or volute design.

12. The mixing device according claim 1, wherein the swirl generating element of the mixing device is designed as a swirl grille.

13. The mixing device according to claim 12, wherein the swirl grille has at least one of deflector elements and deflector plates distributed over its circumference and is arranged in the exhaust gas recirculation line in the area of the admission opening.

14. Exhaust gas recirculation assembly comprising:

an engine intake air line;

an exhaust gas recirculation line extending into the intake air line at an admission opening, and a swirl generating device disposed at the admission opening and designed to enhance the mixing of exhaust gas with intake air in the intake air line downstream of the admission opening.

15. Exhaust gas recirculation assembly according to claim 14, wherein the engine intake air line and the exhaust gas recirculation line are concentric to one another with the exhaust gas recirculation line inside the intake air line at the admission opening.

16. Exhaust gas recirculation assembly according to claim 14, wherein the swirl generating element includes a baffle element for the exhaust gas in an area of the admission opening.

17. Exhaust gas recirculation assembly according to claim 14, wherein the swirl generating device includes a swirl duct at an exit end of the exhaust gas recirculation line at the admission opening.

18. Exhaust gas recirculation assembly according to claim 17, wherein on its inside in the area of the admission opening the swirl duct has deflector elements for the exhaust gas, which deflector elements are of helical and/or volute design.

19. Exhaust gas recirculation assembly according to claim 14, wherein the swirl generating device includes a swirl grille.

20. Exhaust gas recirculation assembly according to claim 19, wherein the swirl grille has at least one of deflector elements and deflector plates distributed over its circumference and is arranged in the exhaust gas recirculation line in the area of the admission opening.

* * * * *